US012448776B2

(12) United States Patent
Xu et al.

(10) Patent No.: US 12,448,776 B2
(45) Date of Patent: Oct. 21, 2025

(54) LOUVERED CANOPY

(71) Applicants: Gaoyang Xu, Taizhou (CN); Ruzhong Yin, Taizhou (CN); Yiyao Wang, Taizhou (CN)

(72) Inventors: Gaoyang Xu, Taizhou (CN); Ruzhong Yin, Taizhou (CN); Yiyao Wang, Taizhou (CN)

(73) Assignee: Zhejiang Dosoly Mechanical and Electrical Technology Co., Ltd., Taizhou (CN)

( * ) Notice: Subject to any disclaimer, the term of this patent is extended or adjusted under 35 U.S.C. 154(b) by 294 days.

(21) Appl. No.: 18/236,905

(22) Filed: Aug. 22, 2023

(65) Prior Publication Data

US 2024/0068241 A1 Feb. 29, 2024

(30) Foreign Application Priority Data

Aug. 24, 2022 (CN) ..... 202222269677.8

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04F 10/08; E04F 10/005; E04F 10/00; E04B 7/166
See application file for complete search history.

(56) References Cited

U.S. PATENT DOCUMENTS

| | | | | |
|---|---|---|---|---|
| 6,421,966 | B1 | 7/2002 | Braunstein et al. | |
| 7,568,319 | B2 | 8/2009 | Fairbairn | |
| 9,422,715 | B1 | 8/2016 | Selzer | |
| 10,988,936 | B2 | 4/2021 | Soetanto | |
| 11,149,438 | B2 | 10/2021 | Torman et al. | |
| 11,421,422 | B2 * | 8/2022 | Zhao | E04F 10/10 |
| 11,686,101 | B2 * | 6/2023 | Liang | H02S 20/10 160/188 |
| 11,834,837 | B2 * | 12/2023 | Wang | E04F 10/10 |

(Continued)

FOREIGN PATENT DOCUMENTS

| | | | |
|---|---|---|---|
| CA | 2971702 | A1 | 6/2016 |
| CN | 200620017375 | Y | 8/2007 |

(Continued)

*Primary Examiner* — Beth A Stephan
(74) *Attorney, Agent, or Firm* — Minder Law Group; Willy H. Wong

(57) ABSTRACT

The present louvered canopy includes a louver blade directional switching element and a control bar. The control bar is vertically provided and inserted inside a vertical column of the louvered canopy and capable of swinging. The louver blade directional switching element includes a hinged lever member and a fulcrum member, a first end of the fulcrum member being fixed to a middle part of the hinged lever member, while a second end of the fulcrum member being hinged to a frame of the louvered canopy. The hinged lever member has an effort end and a load end, the effort end being located below the load end, and the effort end and the load end being located on opposite sides of the fulcrum member, respectively, the effort end being hinged to the control bar, while the load end being connected to the louver blades through a linkage transmission mechanism.

7 Claims, 10 Drawing Sheets

(56) References Cited

U.S. PATENT DOCUMENTS

| | | | | |
|---|---|---|---|---|
| 12,195,976 | B2 * | 1/2025 | Sun | E04F 10/10 |
| 2004/0031233 | A1 | 2/2004 | Cope et al. | |
| 2013/0082115 | A1 | 4/2013 | May et al. | |
| 2021/0363752 | A1 | 11/2021 | Wagaman et al. | |
| 2022/0235555 | A1 | 7/2022 | Liang | |

FOREIGN PATENT DOCUMENTS

| | | | |
|---|---|---|---|
| CN | 201010205386 | A | 12/2011 |
| CN | 201120067135 | U | 4/2012 |
| CN | 201220446372 | U | 3/2013 |
| CN | 201620468931 | U | 10/2016 |
| CN | 201720575395 | U | 1/2018 |
| CN | 201820620993 | U | 8/2018 |
| CN | 201721796462 | U | 9/2018 |
| CN | 201721799953 | U | 9/2018 |
| CN | 201820313025 | U | 12/2018 |
| CN | 201910976164 | A | 12/2019 |
| CN | 201920735503 | U | 2/2020 |
| CN | 201921829932 | U | 8/2020 |
| CN | 202021194839 | U | 6/2021 |
| CN | 202120988735 | U | 6/2022 |
| CN | 202220564088 | U | 6/2022 |
| EP | 3246494 | A1 | 11/2017 |
| EP | 3234273 | B1 | 5/2020 |
| FR | 2947845 | A1 | 1/2011 |

* cited by examiner

LOUVERED CANOPY

RELATED APPLICATIONS

This application claims priority to Chinese Patent Application No. CN202222269677.8, filed Aug. 24, 2022.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention pertains to the technical field of louvered canopies, and relates to a louvered canopy.

BACKGROUND

A louvered canopy is a type of architectural structure that provides shade or shelter from weather conditions such as wind, rain and sun and prevents injuries from falling objects. It typically comprises: a vertical column, a frame fixed to an upper end of the vertical column, a number of louver blades parallel to each other and hinged to the frame, and a transmission mechanism that drives the louver blades to open and close to realize both sun shading and adjustment of sunlight angle. An example of a louvered canopy is disclosed in Chinese patent Application No.: CN201920735503.1, which comprises: a frame; a number of louver blades arranged on the frame, each louvered blade having a rotary shaft that is fixed to the louvered blade and rotationally connected to the frame, each rotary shaft being provided with a pivot bar that is fixed to the rotary shaft; and a linkage bar that is provided on the frame and capable of swinging, with all the pivot bars being fixed to the linkage bar. A swinging motion of the linkage bar can drive all the pivot bars to pivot, causing the louver blades to rotate, thereby achieving opening and closing of the louver blades.

Currently, there are two methods for controlling opening and closing of louver blades in a louvered canopy: manual control and electrical control. Manual control allows for freely control of the louver blades without being influenced by environmental factors. In an existing manual control structure, the following design is used to facilitate manual operation: a control rod is provided inside a vertical column of the louvered canopy, a flexible shaft made of a flexible material is provided at an upper end of the control rod, a worm gearbox is disposed between the flexible shaft and a linkage rod, and a bevel gear assembly capable of driving rotation of the control rod is provided at a lower end of the control rod. In this design, the bevel gear assembly drives rotation of the control rod, which in turn rotates the flexible shaft; the flexible shaft further drives rotation of a worm wheel within the worm gearbox, where the worm wheel meshes with a worm gear, resulting in rotation of the worm gear; finally, the worm gear drives horizontal movement of the linkage rod. However, this design has several drawbacks: it has a long transmission stroke, and requires a substantial amount of force to operate; the flexible shaft is subject to high wear and tear, leading to fatigue damage after prolonged use and necessitating replacement, causing operational inconvenience. Another existing manual control structure utilizes a multi-gear-set transmission consisting of multiple sets of gear parts. This design converts rotary or vertical motion at a manual operation end into horizontal motion, which is then transmitted to the louver blades. However, due to backlash between each gear set, there is a considerable cumulative backlash among the multiple gear sets. As a result, not only does the overall structure become complex, but there is also a significant loss of precision and stability.

SUMMARY

Some objectives of embodiments of the present invention are to provide a louvered canopy with respect to the above defects in the prior art, to solve the technical problem on how to more conveniently control opening and closing of louver blades and achieve a louvered canopy with a simple structure and decreased wear and tear.

The objectives of the present invention can be achieved by the following technical solution. A louvered canopy, comprising: a vertical column, a frame provided at an upper end of the vertical column, louver blades hinged to the frame and capable of opening and closing, and a control structure capable of controlling opening and closing of the louver blades, wherein the control structure comprises a louver blade directional switching element and a control bar, the control bar being vertically provided and inserted inside the vertical column and capable of swinging up and down, the louver blade directional switching element comprises a hinged lever member and a fulcrum member, a first end of the fulcrum member being fixed to a middle part of the hinged lever member, while a second end of the fulcrum member being hinged to the frame, the hinged lever member has an effort end and a load end, the effort end being located below the load end, and the effort end and the load end being located on opposite sides of the fulcrum member, respectively, the effort end is hinged to an upper end of the control bar, the load end is connected to the louver blades through a linkage transmission mechanism, the control structure further comprises a manual drive assembly provided on the vertical column and capable of driving the control bar to swing up and down, the manual drive assembly comprises a worm wheel, a worm gear, and a worm-driven bar, the worm gear being rotationally provided on the vertical column and meshing with the worm wheel, a first end of the worm-driven bar being fixed to the worm wheel while a second end of the worm-driven bar being hinged to a lower end of the control bar.

In this technical solution, the design concept is as follows: manually rotation of the worm gear drives the worm wheel to rotate, and the rotation of the worm wheel drives the worm-driven bar, which is fixed to the worm wheel, to move along an arc path; since the second end of the worm-driven bar is hinged to the lower end of the control bar, the upper end of the control bar is hinged to the effort end, and the louver blade directional switching element is hinged to the frame, consequently, the movement of the worm-driven bar drives the control bar to swing up and down and the louver blade directional switching element to pivot around a hinge point between the louver blade directional switching element and the frame; the louver blade directional switching element has three hinge points, which are located at the effort end and the load end of the hinged lever member, as well as the second end of the fulcrum member that is distal from the hinged lever member, respectively, and these hinge points form a triangular structure, that is, the hinged lever member and the fulcrum member form an approximately T-shaped structure, or a lever-like structure, with the hinge point between the fulcrum member and the frame serving as a supporting center, while the effort end and the load end acting as two lateral ends of the lever-like structure; given that the load end is located above the effort end and that the effort end and the load end are on opposite sides of the fulcrum member, the triangular structure facilitates pivot of the load end around the supporting center (i.e., the hinge point between the louver blade directional switching element and the frame) when the control bar swings upward and moves the effort end upward, that is, in essence, the triangular structure enables effective transformation of a vertical motion component of the effort end into a horizontal motion component of the load end, and the transformed horizontal motion component is then transmitted to the linkage transmission mechanism to ultimately drive the louver blades to open or close.

The combination arrangement of the three parts—the worm-driven bar, the control bar, and the louver blade directional switching element—enables transformation of a vertical motion component of the worm wheel's rotational movement into a horizontal motion component of the load end, and also achieves structural simplification compared to the aforementioned complex multi-gear-set transmission. Furthermore, the worm-driven bar, the control bar, and the louver blade directional switching element are interconnected through hinged connections, eliminating the backlash issues associated with traditional multi-gear systems, therefore, compared to the prior art, this design offers higher overall precision, reduced wear and tear, and a stable transmission structure, moreover, the various parts are less prone to fatigue damage, ensuring a long service life even with prolonged use.

In addition, with this structure, when the hinged lever member tends to shift to one side, that is, when the load end and the effort end are located on the left and right sides of the hinge point between the fulcrum member and the frame, respectively, the shift tendency of the hinged lever member will be amplified at the load end. Meanwhile, a weight of the louver blades and a weight of several auxiliary mechanisms connected to the load end through the linkage transmission mechanism assist the hinged lever member in driving the louver blades, thus reducing to some extent a force that a user needs to indirectly apply to the hinged lever member for driving opening and closing of the louver blades, making operation more convenient.

Furthermore, by setting a distance from the effort end to the supporting center (i.e., the hinge point between the louver blade directional switching element and the frame) greater than a distance from the load end to the supporting center, it allows for a more effortless operation by using the principle of a lever.

In one embodiment of the above louvered canopy, a reinforcing member is provided between the load end and the fulcrum member, two ends of the reinforcing member being fixed to the load end and the fulcrum member, respectively. By providing the reinforcing member, the three parts—the reinforcing member provided between the load end and the fulcrum member, the load end, and the fulcrum member—form a triangular structure, which can effectively support the load end, transfer the applied force from the load end to the fulcrum member, limit deformation of the load end, enhance structural stability, and ensure precision.

In one embodiment of the above louvered canopy, the reinforcing member has one end fixed to a tip portion of the load end and the other end fixed to the second end of the fulcrum member that is distal from the hinged lever member. By fixing the two ends of the reinforcing member to the tip portion of the load end and the second end of the fulcrum member, respectively, it expands the triangular structure formed by the load end, the fulcrum member, and the reinforcing member, and further enhances structural stability.

In one embodiment of the above louvered canopy, a connecting bar capable of bringing the louver blades to rotate is hinged by a first pivot pin at a connection point between the reinforcing member and the load end, while a connection point between the reinforcing member and the fulcrum member is hinged to the frame by a second pivot pin. By setting the hinge points on the louver blade directional switching element to be strategically located at intersections between the reinforcing member and corresponding intersecting parts, it ensures forces acting on the hinge positions to be immediately distributed by the intersecting parts, thereby effectively preventing deformation of the louver blade directional switching element.

In one embodiment of the above louvered canopy, the upper end of the control bar is provided with two hinge plates arranged vertically and parallel to each other, allowing the effort end to be positioned between the two hinge plates and hinged to the hinge plates, the effort end having a gradually increasing width in a direction towards the fulcrum member. This gradual increase in width of the effort end in the direction towards the fulcrum member enhances the structural strength of the effort end. Meanwhile, the effort end, positioned between the two hinge plates, is able to rotate around its hinge point where it is hinged to the hinge plates. If the width of the effort end is too long, it may collide with the upper end of the control bar during movement. To prevent this, the length of the hinge plates needs to be adjusted accordingly, and a width of a tip portion of the effort end, distal from the fulcrum member, is designed to be relatively small, which ensures that there is no collision between the effort end and the upper end of the control bar, and allows the hinge plates to have an appropriate vertical length without the need for excessive elongation to prevent collision between the effort end and the control bar.

In one embodiment of the above louvered canopy, the fulcrum member, the hinged lever member, and the reinforcing member are integrally formed by molding, and a maximum width of the effort end is less than half a width of the louver blade directional switching element at the position of the fulcrum member. During integral forming (by molding), the same material is used for all parts. By connecting the two ends of the reinforcing member to a tip portion of the load end and the second end of the fulcrum member, respectively, and setting a maximum width of the effort end to be less than half a width of the louver blade directional switching element at the position of the fulcrum member (in other words, setting a width of the louver blade directional switching element at the position of the fulcrum member to be at least twice a width of the effort end), it guarantees that the width of the louver blade directional switching element at the position of the fulcrum member is sufficiently large when designed to meet a minimum structural strength requirement, ensuring a sufficiently large rotation radius for the entire louver blade directional switching element during pivoting, allowing for an amplified horizontal travel distance of the louver blades and reducing an amount of movement required in manual operation.

In one embodiment of the above louvered canopy, the manual drive assembly is fixed to a middle part of the vertical column, the worm gear is arranged horizontally and has one end penetrating through the vertical column, allowing a handle to be fixed to the worm gear. This arrangement enables a user to manually rotates the handle, which in turn drives the worm wheel. The worm wheel then drives the worm gear. Consequently, the worm gear drives the worm-driven bar, causing the louver blade directional switching element to pivot. The utilization of the worm-wheel-and-worm-gear mechanism is simple and facilitates the opening and closing of the louver blades.

Compared to the prior art, the present louvered canopy has the following advantages:

1. In the present application, the combination arrangement of the three parts—the worm-driven bar, the control bar, and the louver blade directional switching element—enables transformation of a vertical motion component of the worm wheel's rotational movement into a horizontal motion component of the load end, and also achieves structural simplification compared to the aforementioned complex multi-gear-set transmission. Furthermore, the worm-driven bar, the control bar, and the louver blade directional switching element are interconnected through hinged connections, eliminating the backlash issues associated with traditional multi-gear systems, therefore, compared to the prior art, this design offers higher overall precision, reduced wear and tear, and a stable transmission structure, moreover, the various parts are less prone to fatigue damage, ensuring a long service life even with prolonged use.

2. When the hinged lever member tends to shift to one side, that is, when the load end and the effort end are located on the left and right sides of the hinge point between the fulcrum member and the frame, respectively, the shift tendency of the hinged lever member will be amplified at the load end. Meanwhile, a weight of the louver blades and a weight of several auxiliary mechanisms connected to the load end through the linkage transmission mechanism assist the hinged lever member in driving the louver blades, thus reducing to some extent a force that a user needs to indirectly apply to the hinged lever member for driving opening and closing of the louver blades, making operation more convenient.

DETAILED DESCRIPTION

Set forth below are specific embodiments of the present invention and a further description of the technical solutions of the present invention in conjunction with the accompanying drawings, but the present invention is not limited to these embodiments.

Figure 1:
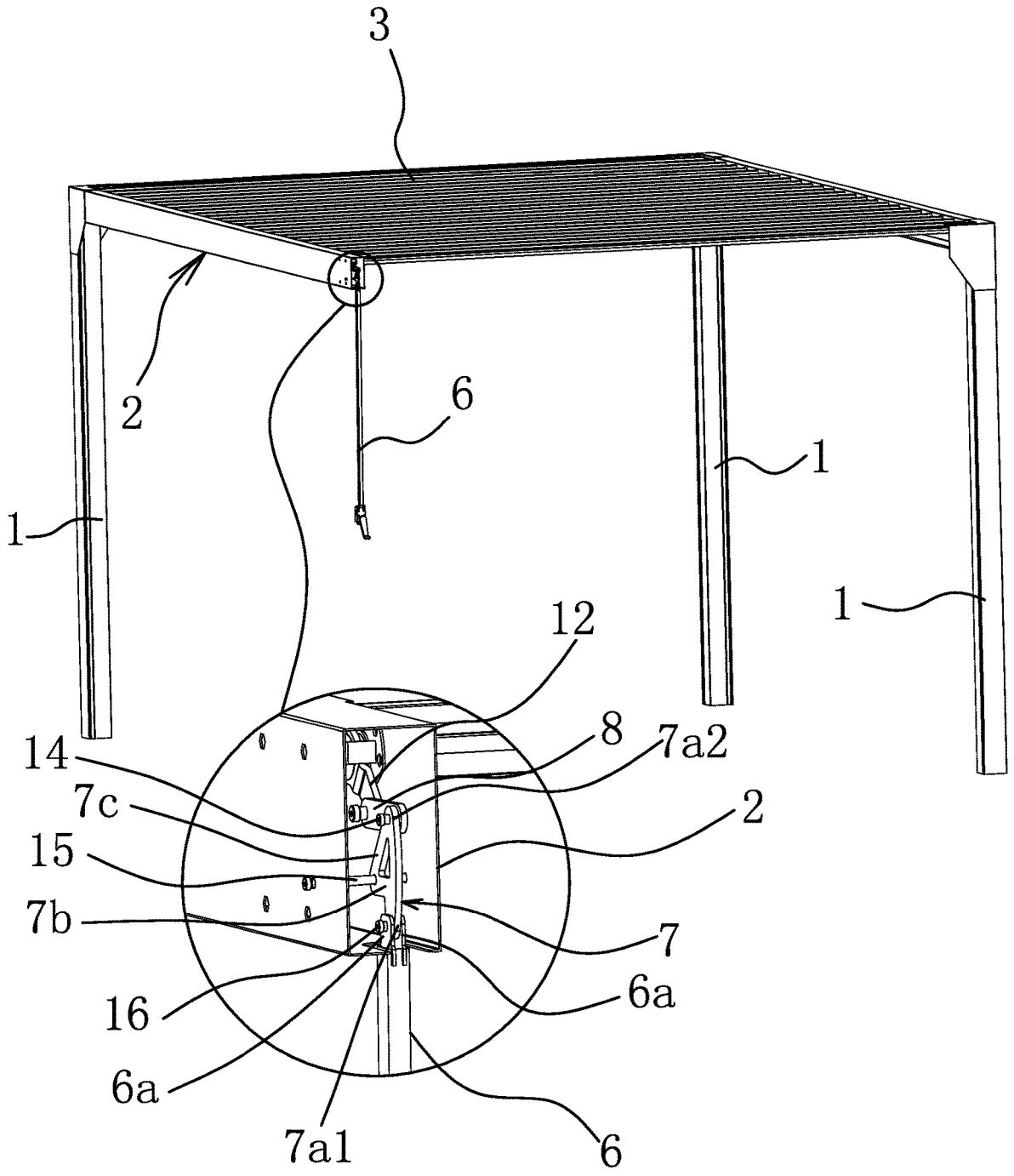
FIG. 1 is a first partial perspective view of a control structure of the present louvered canopy.
Figure 2:
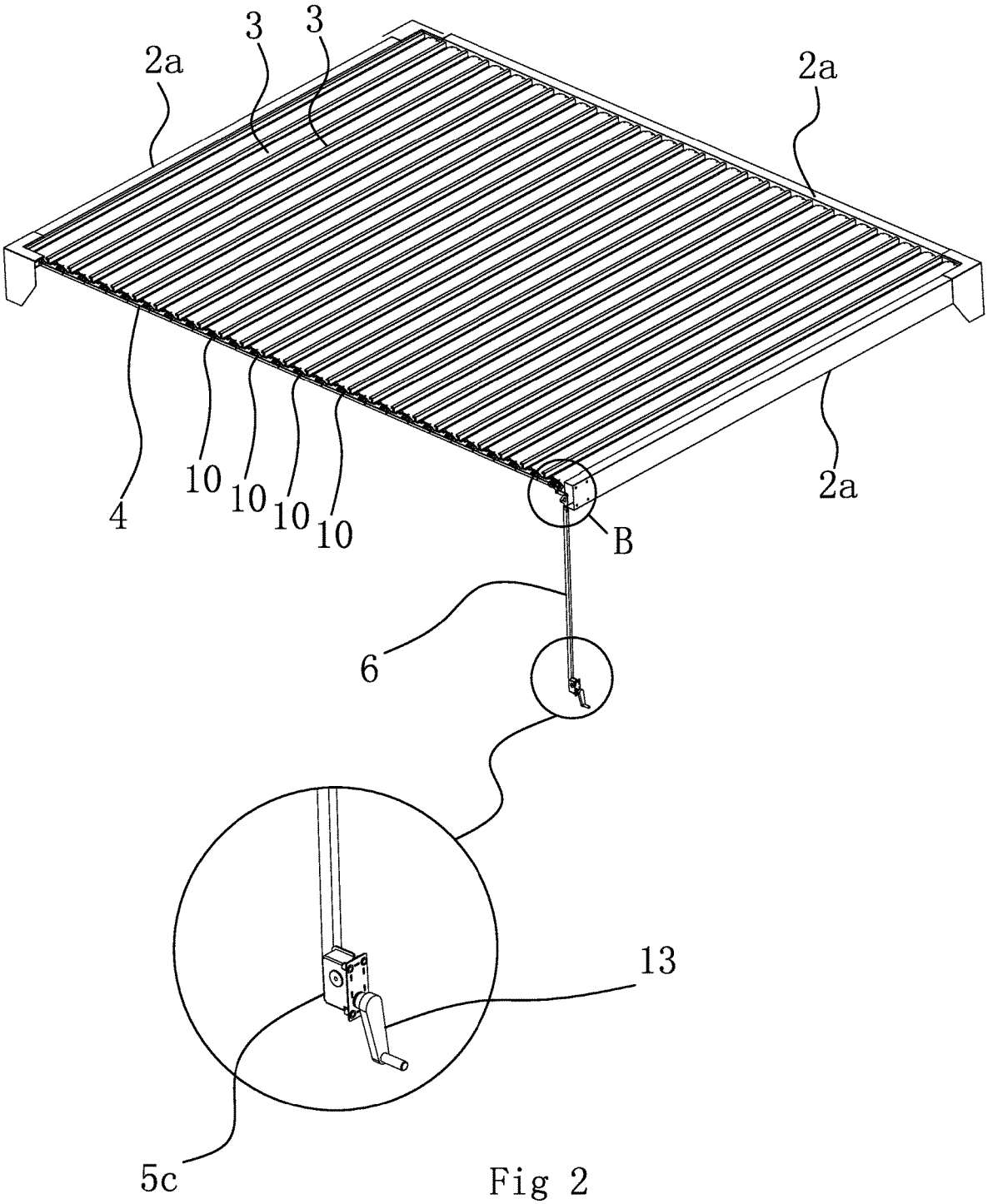
FIG. 2 is a second partial perspective view of the control structure of the present louvered canopy.
Figure 3:
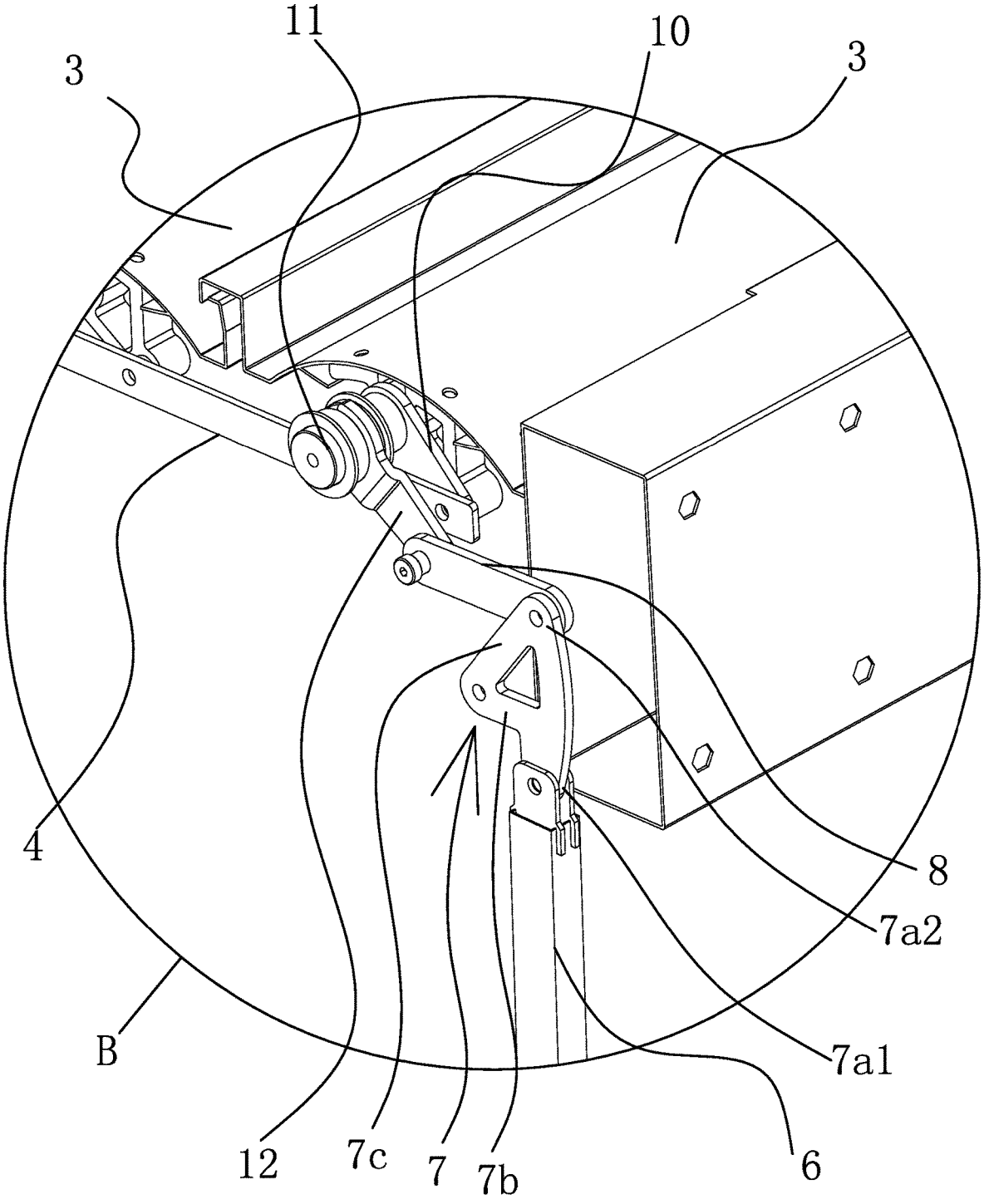
FIG. 3 is an enlarged view of section B in FIG. 2.
Figure 4:
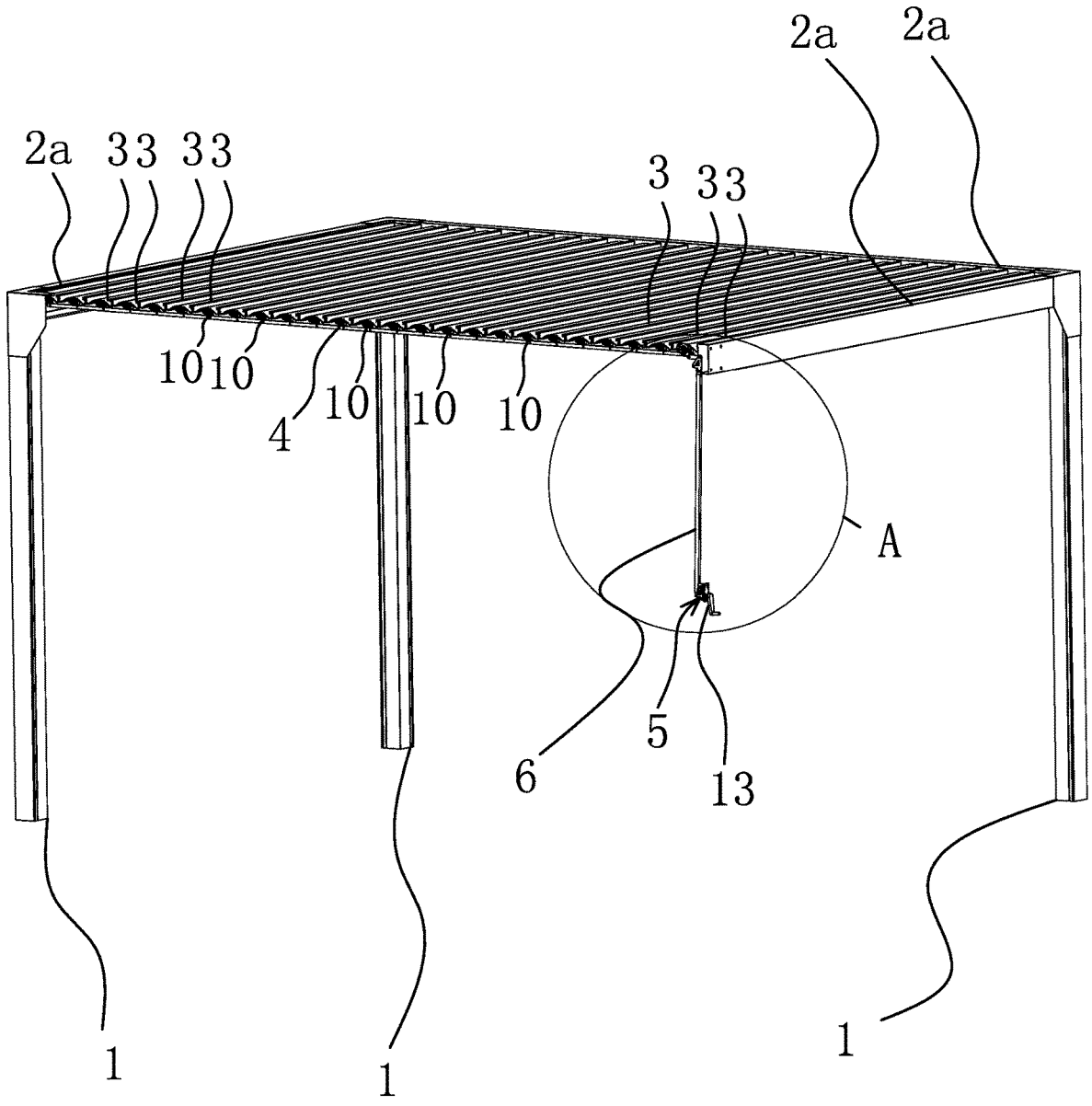
FIG. 4 is a partial perspective view of the present louvered canopy.
Figure 10:
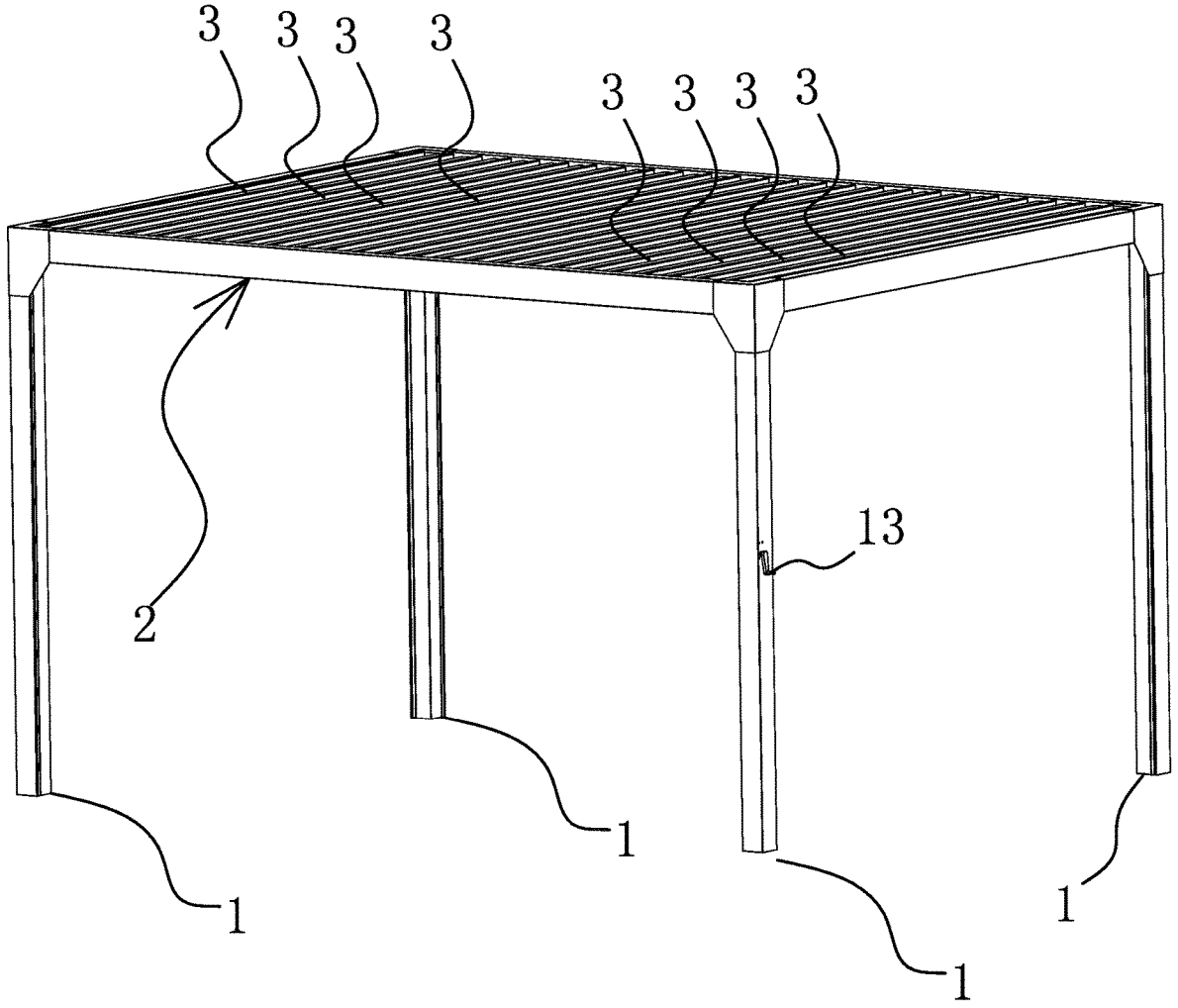
FIG. 10 is a perspective view of the present louvered canopy.

As shown in FIGS. 1 and 10, a louvered canopy comprises: a vertical column 1, and a frame 2 provided at a top end of the vertical column 1. A total of four vertical columns 1 are provided and disposed vertically. The frame 2 is in a rectangular shape and formed by enclosing four elongated frame beams 2*a*. As shown in FIGS. 2 and 3, a plurality of parallel louver blades 3 are rotatably connected to the frame 2. One end of each of the louver blades 3 extends into one of the frame beams 2*a* and is provided with a crank arm 10 fixed thereto, while the other end of each of the louver blades 3 extends into an opposite frame beam 2*a*. All the cranks arm 10 are hinged together to a linkage bar 4, which is horizontally provided inside the frame beam 2*a*. When the linkage bar 4 swings, all the cranks arms 10 follow the linkage bar to rotate, thereby realizing opening or closing of the louver blades 3. Referring to FIG. 2, one end of one of the louver blades 3 is fixed with a rotary shaft 11, and the rotary shaft 11 is fixed with an actuation bar 12 which is parallel to and in the same orientation as the crank arm 10. The actuation bar 12 is used to input power to rotate the rotary shaft 11, thus using the one louver blade 3 to cause a row of louver blades 3 to swing. The louvered canopy further comprises a control structure for controlling opening and closing of the louver blades 3. The control structure comprises a control bar 6 and a manual drive assembly 5. The control bar 6 is vertically provided inside one of the vertical columns 1 and is capable of swinging inside the vertical column 1. Referring to FIG. 4, the manual drive assembly 5 is located at a middle part of the vertical column 1, a lower end of the control bar 6 is hinged to the manual drive assembly 5, the manual drive assembly 5 is used to input power to swing the control bar 6, an upper end of the control bar 6 is connected to the linkage bar 4 through a transmission mechanism, and the control bar 6 can drive the linkage bar 4 to swing when it swings.

Figure 7:
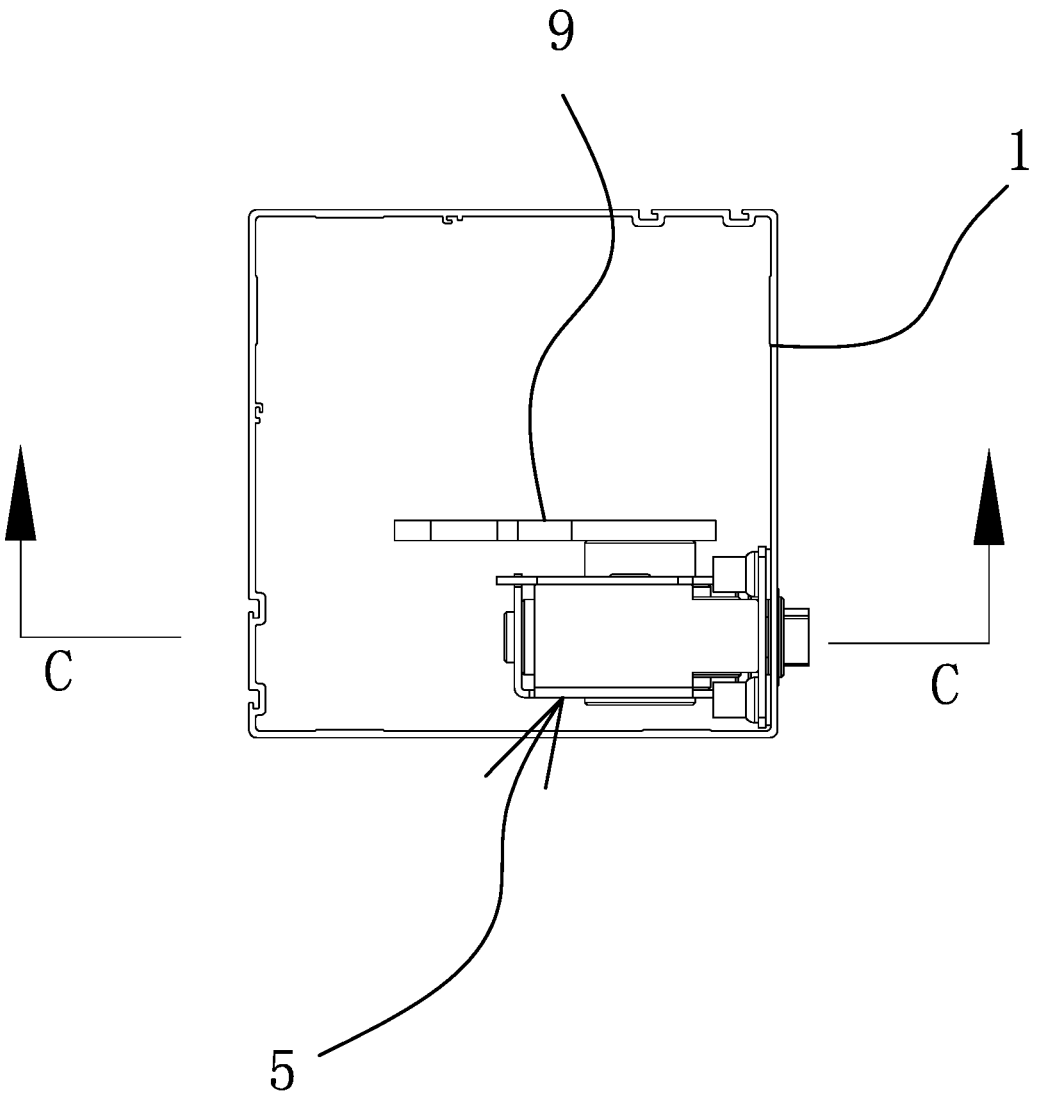
FIG. 7 is a top view of a manual drive assembly provided inside a vertical column of the present louvered canopy.
Figure 8:
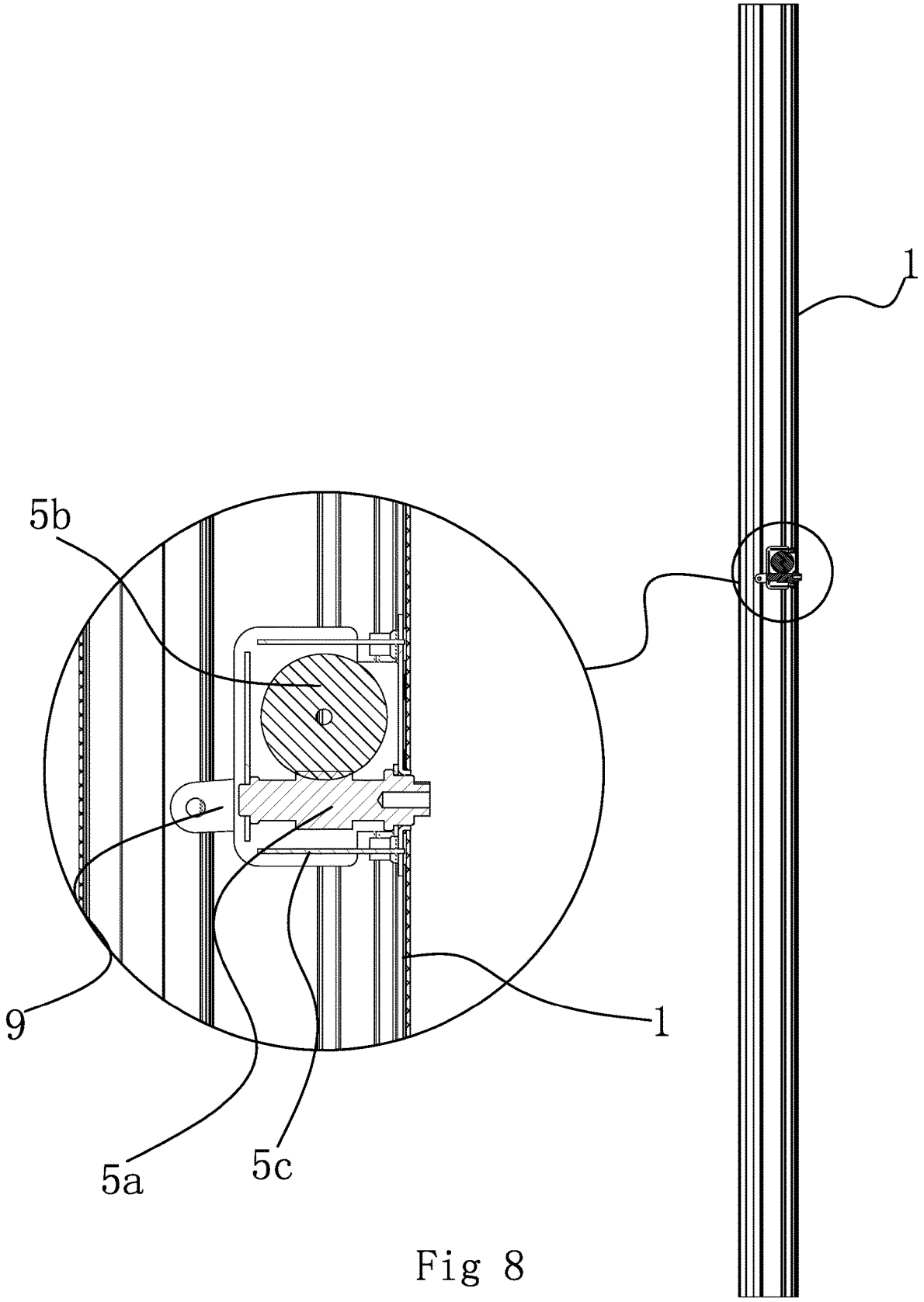
FIG. 8 is a cross-sectional view along line C-C in FIG. 7.
Figure 9:
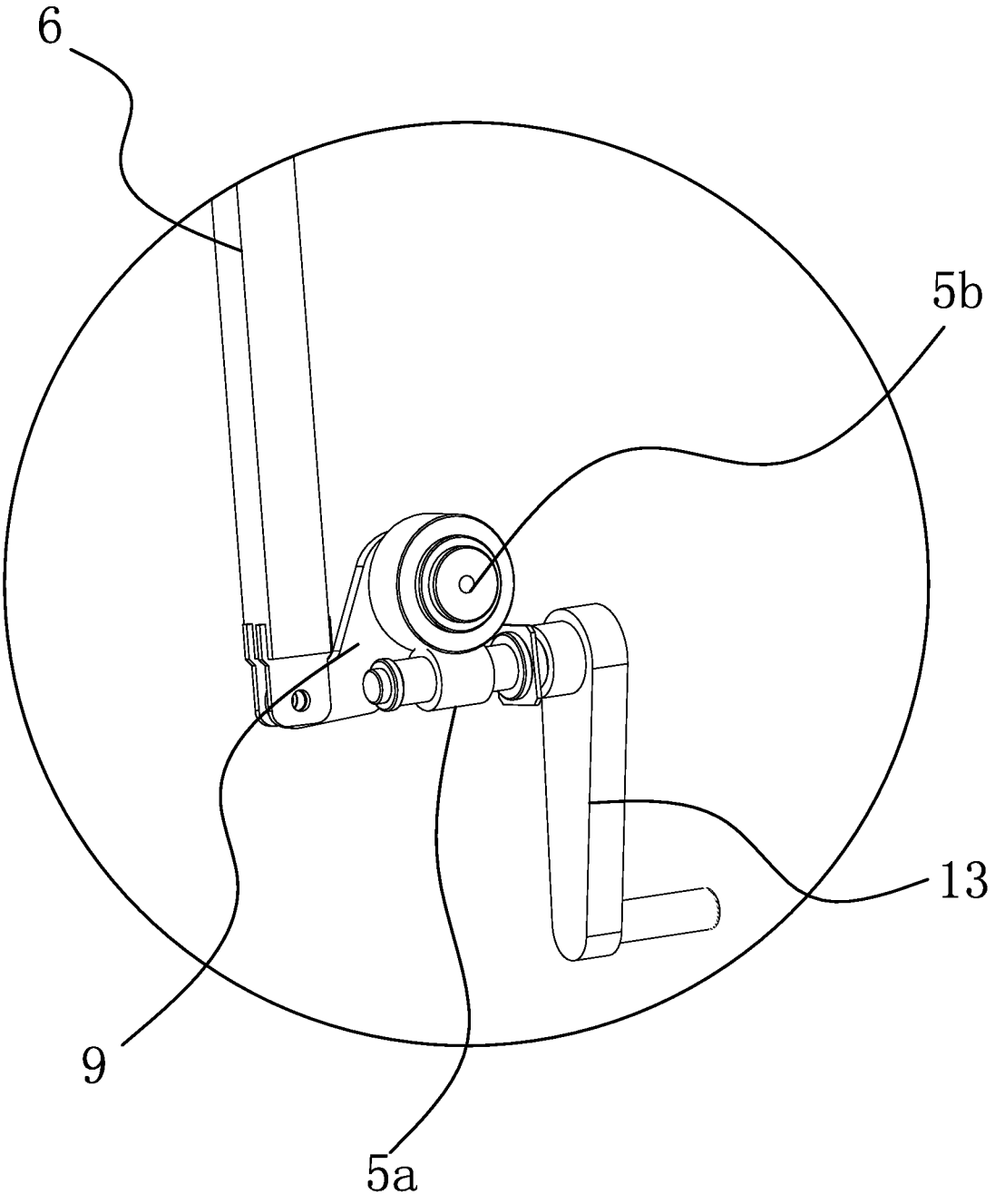
FIG. 9 is an enlarged view of the manual drive assembly.

In this embodiment, as shown in FIGS. 7, 8, and 9, the manual driving assembly 5 comprises a worm gearbox 5*c*, as well as a worm wheel 5*b* and a worm gear 5*a*, both located within the worm gearbox 5*c*. The worm gear 5*a* is rotationally mounted on the worm gearbox 5*c* and horizontally arranged, and extends out of the vertical column 1 at one end, where a handle 13 is fixed to the worm gear 5*a*. The worm gear 5*a* is rotationally connected to the vertical column 1. The worm wheel 5*b* is also rotationally mounted on the worm gearbox 5*c* and meshes with the worm gear 5*a*. The lower end of the control bar 6 is hinged to a worm-driven bar 9, with one end of the worm-driven bar 9 being fixed to the worm wheel 5*b*. The rotation of the worm wheel 5*b* causes the entire worm-driven bar 9 to move along an arc path. A user inputs power to cause rotation of the worm gear 5*a*, which in turn rotates the worm wheel 5*b* and drives the worm-driven bar 9, and then the worm-driven bar 9 brings the control bar 6 to swing around its hinge point that is connected to the worm-driven bar 9.

Figure 5:
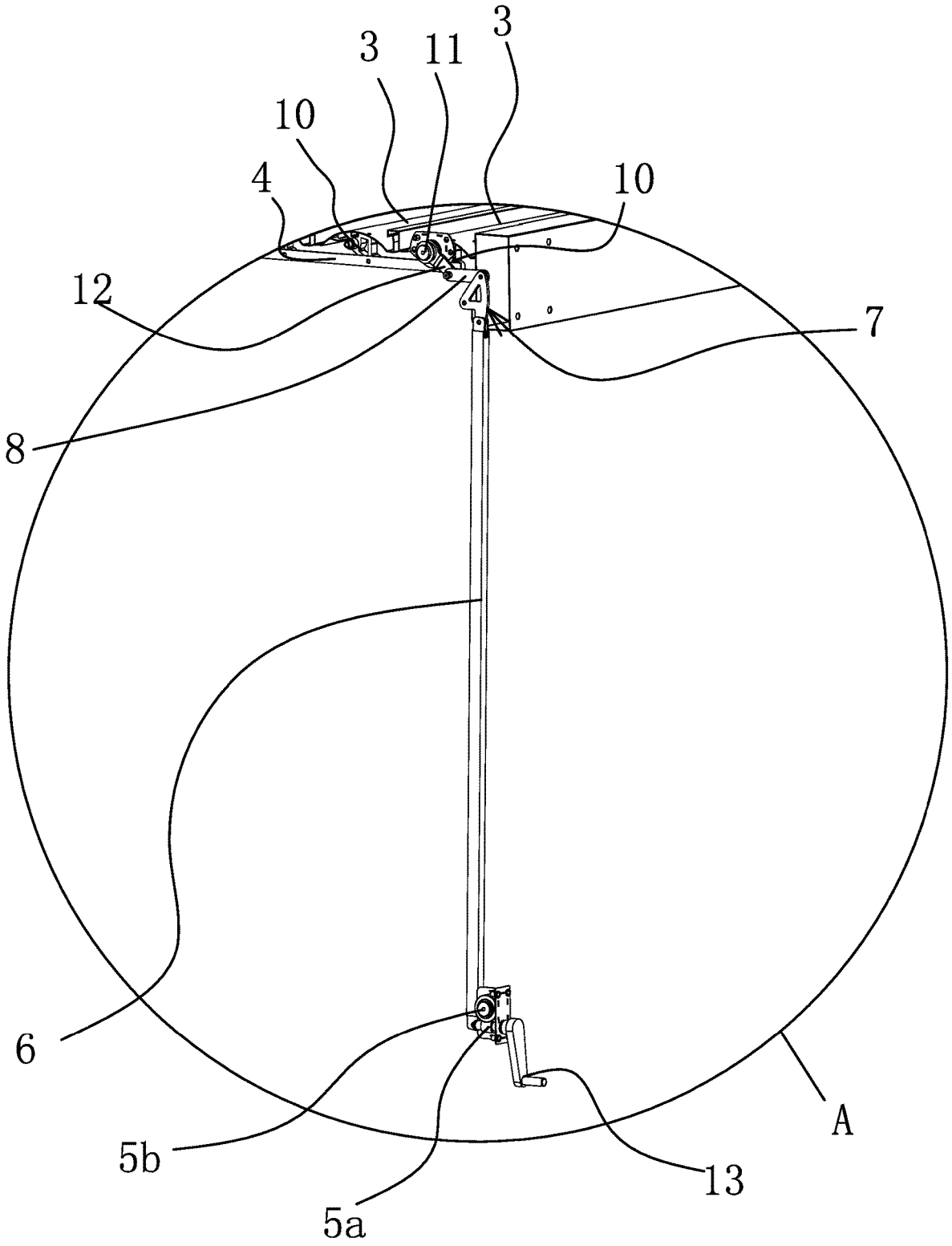
FIG. 5 is an enlarged view of section A in FIG. 4.
Figure 6:
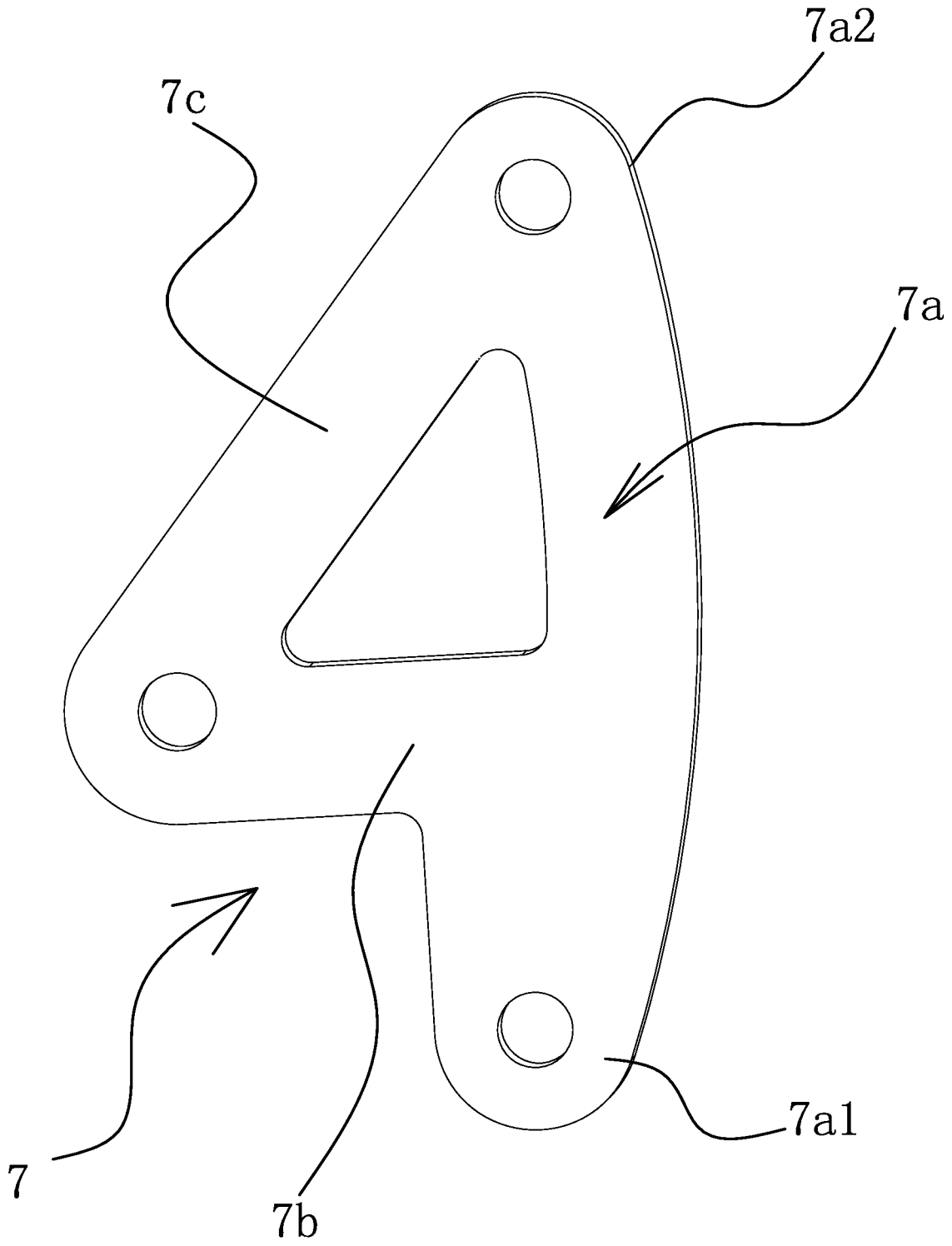
FIG. 6 is a perspective view of a louver blade directional switching element.

As shown in FIGS. 4, 5, and 6, the upper end of control bar 6 extends upward out of the vertical column 1. The control structure further comprises a louver blade directional switching element 7, which is hinged to the upper end of control bar 6. Specifically, the louver blade directional switching element 7 comprises: an elongated hinged lever member 7*a*, and an elongated fulcrum member 7*b* fixed to a middle part of the hinged lever member 7*a*. The hinged lever member 7*a* has two ends, namely, an effort end 7*a*1 and a load end 7*a*2. The load end 7*a*2 is hinged to a connecting bar 8, which is hinged to an actuation bar 12. A reinforcing member 7*c* is provided between the load end 7*a*2 and the fulcrum member 7*b*, with two ends of the reinforcing member 7*c* being fixed to the load end 7*a*2 and one end of the fulcrum member 7*b* that is distal from the hinged lever member 7*a*, respectively, so that the three parts—the fulcrum member 7*b*, the load end 7*a*2, and the reinforcing member 7*c*—form a triangular structure, which ensures structural stability. Referring to FIG. 1, an intersection of the reinforcing member 7*c* and the load end 7*a*2 is hinged to the connecting bar 8 via a first pivot pin 14, while an intersection of the reinforcing member 7*c* and the fulcrum member 7*b* is hinged to the frame 2 via a second pivot pin 15. The upper end of control bar 6 is provided with two parallel and vertically provided hinge plates 6*a*. The effort end 7*a*1 is located between the two hinge plates 6*a* and is hinged to them via a third pivot pin 15. A width of the effort end 7*a*1 gradually increases towards the direction of the fulcrum member 7*b* until it reaches the fulcrum member 7*b*, with a maximum width of the effort end 7*a*1 being less than half a width of the louver blade directional switching element 7 at the position of the fulcrum member 7*b*. The width increase of the effort end 7*a*1 enhances its structural strength. The hinged lever member 7*a*, the reinforcing member 7*c*, and the fulcrum member 7*b* are all integrally formed by molding with aluminum. The effort end 7*a*1 is always located below the load end 7*a*2. Therefore, when the hinged lever member 7*a* tends to shift to one side, that is, when the load end 7*a*2 and the effort end 7*a*1 are located on the left and right sides of the hinge point between the fulcrum member 7*b* and the frame 2, respectively, the shift tendency of the hinged lever member 7*a* will be amplified at the load end 7*a*2. A weight of the louver blades 3 and a weight of several auxiliary mechanisms connected to the load end 7*a*2 through the linkage transmission mechanism assist the hinged lever member 7*a* in driving the louver blades 3, thus reducing to some extent a force that a user needs to indirectly apply to the hinged lever member 7*a* for driving opening and closing of the louver blades 3, making operation more convenient.

The specific embodiments described herein are merely illustrative examples of the spirit of the present invention. A person skilled in the art to which the present invention pertains can make various modifications or supplementations to the specific embodiments described above, or adopt similar approaches, without departing from the spirit of the present invention or going beyond the scope defined by the appended claims.

Although terms, such as vertical column and control bar, are used extensively herein, it does not exclude the possibility of using other terms. The use of these terms is solely for the purpose of conveniently describing and explaining the essence of the present invention, while construing them as any additional limitations would go against the spirit of the present invention.

REFERENCED PARTS

1 Vertical column
2 Frame
2*a* Frame beam
3 Louver blade
4 Linkage bar
5 Manual drive assembly
5*a* Worm gear
5*b* Worm wheel
5*c* Worm gearbox
6 Control bar
6*a* Hinge plate
7 Louver blade directional switching element
7*a* Hinged lever member
7*a*1 Effort end
7*a*2 Load end
7*b* Fulcrum member
7*c* Reinforcing member
8 Connecting bar
9 Worm-driven bar
10 Crank arm
11 Rotary shaft
12 Actuation bar
13 Handle
14 First pivot pin
15 Second pivot pin
16 Third pivot pin

The invention claimed is:

1. A louvered canopy, comprising:

a vertical column;

a frame provided at an upper end of the vertical column, louver blades hinged to the frame and capable of opening and closing; and a control structure capable of controlling opening and closing of the louver blades;

wherein the control structure comprises a louver blade directional switching element and a control bar, the control bar being vertically provided and inserted inside the vertical column and capable of swinging up and down, the louver blade directional switching element comprises a hinged lever member and a fulcrum member, a first end of the fulcrum member being fixed to a middle part of the hinged lever member, while a second end of the fulcrum member being hinged to the frame, the hinged lever member has an effort end and a load end, the effort end being located below the load end, and the effort end and the load end being located on opposite sides of the fulcrum member, respectively, the effort end is hinged to an upper end of the control bar, the load end is connected to the louver blades through a linkage transmission mechanism, the control structure further comprises a manual drive assembly provided on the vertical column and capable of driving the control bar to swing up and down, the manual drive assembly comprises a worm wheel, a worm gear, and a worm-driven bar, the worm gear being rotationally provided on the vertical column and meshing with the worm wheel, a first end of the worm-driven bar being fixed to the worm wheel while a second end of the worm-driven bar being hinged to a lower end of the control bar.

2. The louvered canopy as claimed in claim 1, wherein a reinforcing member is provided between the load end and the fulcrum member, two ends of the reinforcing member being fixed to the load end and the fulcrum member, respectively.

3. The louvered canopy as claimed in claim 2, wherein the reinforcing member is fixed to the second end of the fulcrum member that is distal from the hinged lever member.

4. The louvered canopy as claimed in claim 3, wherein a connecting bar capable of bringing the louver blades to rotate is hinged by a first pivot pin at a connection point between the reinforcing member and the load end, while a connection point between the reinforcing member and the fulcrum member is hinged to the frame by a second pivot pin.

5. The louvered canopy as claimed in claim 3, wherein the upper end of the control bar is provided with two hinge plates arranged vertically and parallel to each other, allowing the effort end to be positioned between the two hinge plates and hinged to the hinge plates, the effort end having a gradually increasing width in a direction towards the fulcrum member.

6. The louvered canopy as claimed in claim 5, wherein the fulcrum member, the hinged lever member, and the reinforcing member are integrally formed by molding, and a maximum width of the effort end is less than half a width of the louver blade directional switching element at the position of the fulcrum member.

7. The louvered canopy as claimed in claim 1, wherein the manual drive assembly is fixed to a middle part of the vertical column, the worm gear is arranged horizontally and has one end penetrating through the vertical column, allowing a handle to be fixed to the worm gear.

* * * * *